US007464871B2

(12) United States Patent
Neubauer

(10) Patent No.: US 7,464,871 B2
(45) Date of Patent: Dec. 16, 2008

(54) ELECTRONIC PARKING DISC

(75) Inventor: Bent Neubauer, Vejle O (DK)

(73) Assignee: Bent Neubauer Holding ApS, Vejle O (DK)

( * ) Notice: Subject to any disclaimer, the term of this patent is extended or adjusted under 35 U.S.C. 154(b) by 0 days.

(21) Appl. No.: 10/562,119

(22) PCT Filed: Jun. 25, 2004

(86) PCT No.: PCT/DK2004/000450

§ 371 (c)(1),
(2), (4) Date: Mar. 14, 2007

(87) PCT Pub. No.: WO2004/114225

PCT Pub. Date: Dec. 29, 2004

(65) Prior Publication Data

US 2007/0230280 A1 Oct. 4, 2007

(30) Foreign Application Priority Data

Jun. 25, 2003 (DK) ..... 2003 00953

(51) Int. Cl.
*G07B 15/02* (2006.01)

(52) U.S. Cl. ..... 235/384; 235/380; 235/451

(58) Field of Classification Search ..... 235/384, 235/380, 375, 451

See application file for complete search history.

(56) References Cited

U.S. PATENT DOCUMENTS

| | | | | |
|---|---|---|---|---|
| 6,995,755 | B2 * | 2/2006 | Yamaguchi et al. | 345/204 |
| 2003/0125873 | A1 * | 7/2003 | Yamaguchi et al. | 701/211 |

FOREIGN PATENT DOCUMENTS

| | | | |
|---|---|---|---|
| DE | 3829031 | A1 | 3/1989 |
| DE | 9101216.3 | U1 | 5/1992 |
| DE | 19934004 | A1 * | 1/2001 |
| DE | 19934005 | A1 * | 1/2001 |
| DE | 19935689 | A1 | 3/2001 |
| EP | 0719437 | B1 | 8/1998 |
| EP | 1221676 | A2 | 7/2002 |
| WO | 0075878 | A1 | 12/2000 |

* cited by examiner

*Primary Examiner*—Seung H Lee
(74) *Attorney, Agent, or Firm*—David S. Safran; Roberts Mlotkowski; Safran & Cole, P.C.

(57) ABSTRACT

Parking disc for mounting on a vehicle where the parking disc is externally visible and has an externally indicator of the time parking was initiated, the indicator including an electronic display which, during normal driving, is connected to an electronic clock which shows the actual time and where stopping the vehicle causes switching of the display to constantly show the time parking commenced, and where the display, when driving resumes, switches to the actual time based on an electric signal from at least one detector which determines an actual relative motion of the vehicle, the switching of the display occurring after determining a minimum value for motion of the vehicle, the switching of the display being effected based on determination by the detector of a minimum acceleration during the movement of the vehicle, the minimum acceleration being determined in a uniform direction over a predetermined period of time.

5 Claims, 1 Drawing Sheet

ELECTRONIC PARKING DISC

BACKGROUND OF THE INVENTION

1. Field of the Invention

The present invention concerns a parking disc for mounting on a vehicle where the parking disc is placed visible from outside, where the parking disc includes means for at least externally indicating a time for initiation of the parking, where means for indicating the time consists of an electronic display which during normal driving is connected to an electronic clock, where the display during normal driving shows the actual time and where stopping the vehicle results in switching of the display, where the display during parking constantly shows the time of initiation of the parking, and where the display by resumption of the driving is switched to the actual time, where switching of the display by resuming the driving occurs on the basis of an electric signal from at least one detector which determines an actual relative motion of the vehicle, where the switching of the display occurs after determining a minimum value for the motion of the vehicle.

2. Description of Related Art

International Patent Application Publication WO 00/75878 discloses an electronic parking disc showing actual time during operation of a vehicle, while at the initiation of parking when the ignition of the vehicle is switched off, the parking disc maintains displaying a fixed time until the next time the ignition is switched on. This prior art has both a forward facing display shaped as a normal Danish parking disc with a single pointer showing hours, and at the inner side of the parking disc there is provided a digital display so that the inwards facing clock during normal operation functions as a normal car clock. In order to ensure optimum display of actual time, the electronic parking disc contains a radio receiver for receiving a long-wave signal from a transmitter transmitting time information, or there is a receiver for receiving GPS satellite signals containing information about time.

The said parking disc has been approved by the authorities in Denmark, but in spite thereof it has various drawbacks. A substantial drawback may be that it is vehicle. Such an action is not allowed according to the common parking rules, but is almost impossible to check. I.e. traffic wardens would be sceptical of this electronic parking disc if they are aware of the possibility of cheating. Thus there may arise a number of contentious issues between traffic wardens and vehicle owners provided with electronic parking discs, as the traffic warden may assert abuse by demonstrating that the car wheels haven't been moved in spite of the parking time having been changed.

German Utility Model DE 2907726 U1 also concerns an electronic parking disc where the clock of the parking disc is satellite controlled. However, any satellite control of a clock in an electronic parking disc will not be very suited for parking in closed parking facilities without free access to open sky. I.e. parking in cellars or the lower storeys in high parking buildings will mean that no satellite signal is received.

German Patent DE 38 29 031 also includes an electronic parking disc which is activated at the absence of an ignition signal and which is deactivated by means of a detector registering, e.g., turning of engine, gearbox or wheels.

SUMMARY OF THE INVENTION

It is the purpose of the invention to provide an electronic parking disc that keeps showing the time of the initiation of the parking even if the ignition of the vehicle is turned on, and where switching to display of actual time only occurs after fulfilling operation conditions in a way that do not allow remote operation.

This may be achieved with a parking disc as the one described in the introduction, if the parking disc is designed so that switching the display is effected on the basis of determination by a detector of a minimum acceleration during the movement of the vehicle.

In a preferred embodiment, switching of the display may be effected on the basis of a minimum acceleration during the movement of the vehicle. Hereby may be achieved that an acceleration detector may be disposed at very different places in the vehicle and emit a signal which could be used for switching the display. In connection with the safety equipment of a vehicle, in some vehicles there is equipment for measuring acceleration beforehand and a signal can be picked up from these detectors and used after processing the signal in the electronic parking disc.

Switching of the display may be effected on the basis of a minimum acceleration determined in a uniform direction over a predetermined period of time. Hereby may be achieved great assurance of a real movement of the vehicle, since if an acceleration detector measures changing direction of an acceleration, this may indicate that the vehicle is subjected to vibrations, e.g. caused by wind action, or that someone pushes the vehicle for achieving a rocking motion in the suspension of the vehicle. If acceleration has been constant in a constant direction over some time, it means that the vehicle has achieved a minimum speed. On the other hand, the absence of an acceleration signal may be used as indication of the initiation of a parking. Therefore, a signal from an accelerometer monitoring the direction of the acceleration will be suitable for performing switching of the display of the parking disc via an electronic control system.

Hereby may be achieved that the electronic parking disc continues to show a fixed time that indicates the start of the parking, until the mentioned detector has determined movement of the vehicle. This may e.g. be that the vehicle has been moved a number of meters in relation to the point at which parking has been initiated. In that way, it will be very difficult to cheat with the electronic parking disc, and during common use of the parking disc by this invention there will not be any problems for the user, as the user with good intentions who do not want to cheat with the display of the parking disc may use the electronic parking disc without disadvantages. At the same time, a parking disc of this type will quickly be accepted by traffic wardens as being a reliable parking disc, whereby cheating may never occur and the actual parking time will never be contended.

By a first preferred embodiment of a parking disc, the switching of the display may be effected on the basis of a minimum distance for the motion of the vehicle determined by a detector. By determining a movement for the vehicle, a detector may e.g. determine that the wheels or a shaft has rotated a certain number of times, possibly in the same direction, before switching of the parking disc is effected. Thereby it will be almost impossible to cheat with the electronic parking disc.

In an alternative embodiment, the switching of the display may be effected on the basis of a minimum speed for the motion of the vehicle determined by a detector. By this may be achieved that the vehicle is to reach a motion speed before switching of the display is effected. Achieving a minimum speed of e.g. 20-30 km/h will not be possible for the vehicle while still standing on a parking lot or while it is moved on a parking lot, and thereby it is ensured that the vehicle is really moved before resetting to display actual time by the parking disc display occurs. This embodiment of the invention will also in the long run gain trust from users as well as from traffic wardens.

The switching of the display may be effected by a detector of the vehicle determining a minimum speed, acceleration or traveled distance, where an existing signal to the automatic door lock of the vehicle for automatic door locking at the exceeding of a minimum sped is simultaneously used for switching the display of the parking disc. Hereby may be achieved that existing detectors in vehicles are utilised for an additional application, which may occur without interfering with the other functions of the vehicle. Switching on of the electronic parking disc is just a question of knowing where to make an electronic connection, after which the electronic parking disc will function optimally.

By a second alternative embodiment, the switching of the display can be effected on the basis of an existing electric signal expressing the speed of the vehicle, where the electronic parking disc includes means for determining a minimum speed on the basis of an existing signal, where the display of the parking disc is switched on the basis of exceeding the determined minimum speed. Hereby may be achieved that e.g. it is an electronic speedometer signal which is used. A signal provided in vehicles using digital speedometers, but also in vehicles where the speedometer communicates with an electronic sensing of one of the rotating shafts of the vehicle. Thus there will typically appear one or more electronic pulses per revolution for this shaft, by which the actual speed is determined on the basis of the time lapsed between electric pulses. A signal of this type coming directly into the electronic parking disc may be used for determining a minimum speed. If the pulses are absent for a period of time, this may be used as indication of parking the vehicle.

A radio wave carried navigation signal may be utilised for indicating the movement of the vehicle for switching the display of the parking disc. Hereby maybe achieved that actual standstill of the vehicle activates the parking disc, while movement of the vehicle causes termination of the parking. GPS signals may be used, but signals from local radio transmitters can also be utilised by determining phase differences between received signals. Signals from cellular transmitter masts may thus be utilised for indicating movement and standstill for a vehicle.

BRIEF DESCRIPTION OF THE DRAWINGS

The only FIGURE shows a possible embodiment of the invention in the form of a block diagram.

DETAILED DESCRIPTION OF THE INVENTION

Figure 1:
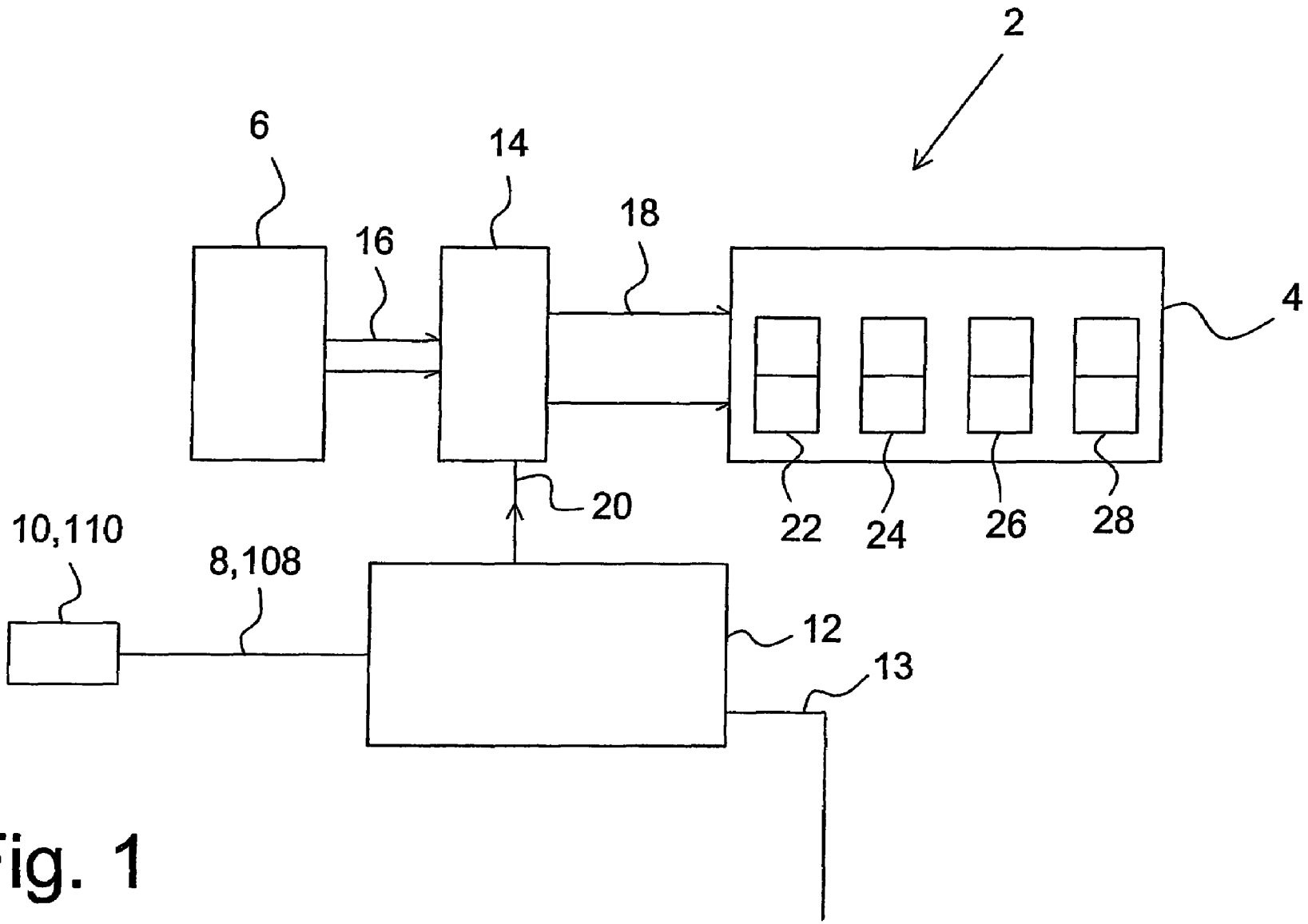

An electronic parking disc 2 contains a display 4 that communicates with an electronic clock 6, where a signal wire 8 communicates with a detector 10 for connecting the detector 10 to a signal processing unit 12. An electric connection 20 goes from signal processing unit 12 to a memory unit 14 that receives a time signal over a databus 16 from the electronic clock 6, and where the memory unit 14 over a databus 18 transmits a signal to display 4 containing segments 22, 24, 26 and 28.

The operation of the parking disc on the FIGURE may be as follows: During normal operation, the electronic clock 6 may deliver a time signal over databus 16, and this signal is forwarded through memory unit 14 over databus 18 to display 4 so that the display shows actual time. A condition for actual display of time may be that the signal wire 20 connecting the electronic control unit 12 with memory unit 14 contains a logical 1. This condition remains unchanged as long as e.g. a signal wire 13 connected to the ignition system of the car indicates that the vehicle is moving. If the vehicle is stopped and/or the ignition signal is interrupted, i.e. the signal wire 13 maybe becomes connected to the chassis, the electronic control unit 12 will interrupt the logical signal on the signal wire 20, after which memory unit 14 is locked for constant display of the time of interruption of the ignition connection 13. The display 4 will thereby show a time for the initiation of the parking. Control unit 12 will keep signal wire 20 at a logical 0 until a signal comes from detector 10 over signal wire 8 indicating that the vehicle is moving. Then the signal wire 20 will change to a logical 1, and memory unit 14 is now opened so that the actual time signal is transferred to display 4.

According to a special embodiment of the invention, control unit 12 may perform a signal processing of the signal transmitted over the signal wire 8, 108. Thereby it may be become possible to utilise a detector 10, 110 which is already provided in a vehicle. This may e.g. be the existing speedometer of the car emitting an electronic speed signal.

A second embodiment of the invention may instead use an accelerometer which is provided in the vehicle beforehand, associated with airbags or other safety devices.

The electronic parking disc may be designed with both an outwards facing display and an inwards facing display, where the outwards facing display may consist of a pointer that may be designed for indicating fixed points in time with intervals of e.g. 15 minutes. The electronic parking disc may include means for manual setting of a time for initiation of the parking. Also, adjustment of the electronic clock may be required. Application of radio-controlled clocks is an obvious possibility, but advantageously the electronic clock may include a local oscillation circuit enabling the electronic clock to continue correct indication of time even if the radio signals are absent. The electronic parking disc may contain an indication of the actual condition, e.g. in a lamp or a light diode indicating parking. Another possibility is that the display is switched off when not parking.

What is claimed is:

1. Parking disc for mounting on a vehicle where the parking disc is placed visible from outside, where the parking disc includes means for at least externally indicating a time for initiation of the parking, where means for indicating the time comprises an electronic display which during normal driving is connected to an electronic clock, where the display during normal driving shows the actual time and where stopping the vehicle results in switching of the display, where the display during parking constantly shows the time of initiation of the parking, and where the display by resumption of the driving is switched to the actual time, where switching of the display by resuming the driving occurs on the basis of an electric signal from at least one detector which determines an actual relative motion of the vehicle, where the switching of the display occurs after determining a minimum value for the motion of the vehicle, wherein the switching of the display is effected on the basis of determination by a detector of a minimum acceleration during the movement of the vehicle, said minimum acceleration being determined in a uniform direction over a predetermined period of time.

2. Parking disc according to claim 1, wherein the switching of the display is also effected on the basis of a minimum distance for the motion of the vehicle determined by a detector.

3. Parking disc according to claim 2, wherein the switching of the display is effected on the basis of an existing electric signal expressing the speed of the vehicle, that the electronic parking disc includes means for determining a minimum speed on the basis of an existing signal where the display of the parking disc is switched on the basis of exceeding the determined minimum speed.

4. Parking disc according to claim 1, wherein the switching of the display is effected on the basis of a minimum speed for the motion of the vehicle determined by a detector.

5. Parking disc according to claim 4, wherein the switching of the display is effected on the basis of an existing electric signal expressing the speed of the vehicle, that the electronic parking disc includes means for determining a minimum speed on the basis of an existing signal, where the display of the parking disc is switched on the basis of exceeding the determined minimum speed.

* * * * *